US005815835A

United States Patent [19]

Craddock

[11] Patent Number: 5,815,835

[45] Date of Patent: Oct. 6, 1998

[54] NECKTIE

[76] Inventor: Hal C. Craddock, 11717 Aprilbud Dr., Richmond, Va. 23233

[21] Appl. No.: 896,441

[22] Filed: Jul. 18, 1997

[51] Int. Cl.[6] ..... A41D 25/00

[52] U.S. Cl. ..... 2/144; D2/600; 2/145; 2/146

[58] Field of Search ..... 2/144, 145, 146, 2/147, 148, 149, 150, 151, 152.1, 153, 154, 155, 156, 157, 52; D2/600, 604, 605, 607, 608

[56] References Cited

U.S. PATENT DOCUMENTS

| | | | |
|---|---|---|---|
| D. 231,959 | 7/1974 | Shah | D2/343 |
| 2,100,870 | 11/1937 | Petrie et al. . | |
| 2,918,678 | 12/1959 | Gonner . | |
| 3,946,444 | 3/1976 | Parrilla . | |

*Primary Examiner*—Jeanette E. Chapman

*Attorney, Agent, or Firm*—William H. Eilberg

[57] ABSTRACT

A necktie includes a wide portion having one or more openings which allow the narrow portion of the necktie to pass through the openings. The openings can take the form of slits or shaped cut-outs. The wide portion preferably contains a first design or color, and the narrow portion contains a second design or color. When the narrow portion is passed through the openings, at least part of the narrow portion becomes visible when the necktie is worn, and the necktie assumes a design which represents a combination of the first and second designs. For example, the wide portion can depict an animal, with the narrow portion depicting the tongue of the animal. In another example, the wide portion can depict a musician, with the narrow portion representing an instrument being played by the musician. The invention therefore provides a necktie in which the narrow portion, which would otherwise be hidden from view and not used effectively, assists in creating an overall design for the necktie.

16 Claims, 7 Drawing Sheets

NECKTIE

BACKGROUND OF THE INVENTION

This invention relates to the field of neckties. The invention provides a necktie which uses the narrow end of the necktie to create unusual and variable designs.

A conventional necktie has a wide portion and a narrow portion, these portions being arranged such that when the necktie is worn, the narrow portion is hidden by the wide portion, and serves no useful purpose, other than in forming a suitable knot. Indeed, the wearer of a conventional necktie must often take steps to insure that the narrow portion will not be seen, such as by using a tie clip or pin that immobilizes the narrow portion behind the wide portion.

It has been known to provide many different kinds of ornamental designs for neckties. However, because only the wide portion of a conventional necktie is visible, only the design appearing on the wide portion has significance. Moreover, the design appearing on the wide portion is static, insofar as the design cannot be varied by the wearer.

The present invention provides a necktie having a narrow portion which can be put to use in creating a design for the necktie. The design produced by the present invention is not static, but can be varied according to the taste of the wearer. Thus, with the necktie of the present invention, the wearer can exercise a degree of creativity and skill in tying and displaying the necktie.

SUMMARY OF THE INVENTION

The necktie of the present invention includes a wide portion and a narrow portion, formed of one or more pieces of fabric. The necktie also has at least one opening, formed in the wide portion, and extending completely through the fabric. When the necktie has been tied in a conventional manner, the narrow portion is inserted through the opening, from the back to the front of the wide portion, so that part of the narrow portion is disposed on the front side of the wide portion. Both the wide portion and the narrow portion may be provided with design elements, such that the design formed on the narrow portion combines with the design formed on the wide portion to produce a new, composite design.

In one embodiment, for example, the wide portion contains a picture of an animal, and the narrow portion depicts a tongue extending from the mouth of the animal. In another embodiment, the wide portion depicts a face of a musician, and the narrow portion depicts an elongated instrument, such as a clarinet, being played by the musician.

In another embodiment, there are a plurality of openings, and the narrow portion of the necktie is inserted through the openings to create a woven effect, the wide and narrow portions of the necktie again combining to form a new, composite design.

The openings may take the form of narrow slits or shaped cut-outs.

The present invention therefore has the primary object of providing a necktie which makes use of its narrow portion to produce a design for the necktie.

The invention has the further object of providing a necktie in which the designs formed on the wide portion and/or the narrow portion combine to form a new, composite design.

The invention has the further object of providing a necktie having a design which can be varied according to the taste of the wearer.

The invention has the further object of allowing the wearer of a necktie to exercise a degree of creativity and skill in adjusting the design depicted by the necktie.

The invention has the further object of providing a necktie which depicts an animal, and in which the narrow portion of the necktie represents a tongue of the animal, extending from the animal's mouth.

The invention has the further object of providing a necktie which depicts the face of a musician, and in which the narrow portion of the necktie represents an elongated instrument being played by the musician.

The invention has the further object of providing a necktie which facilitates the creation of a multiplicity of designs.

The invention has the further object of providing a necktie which makes meaningful and substantial use of the narrow portion of the necktie.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
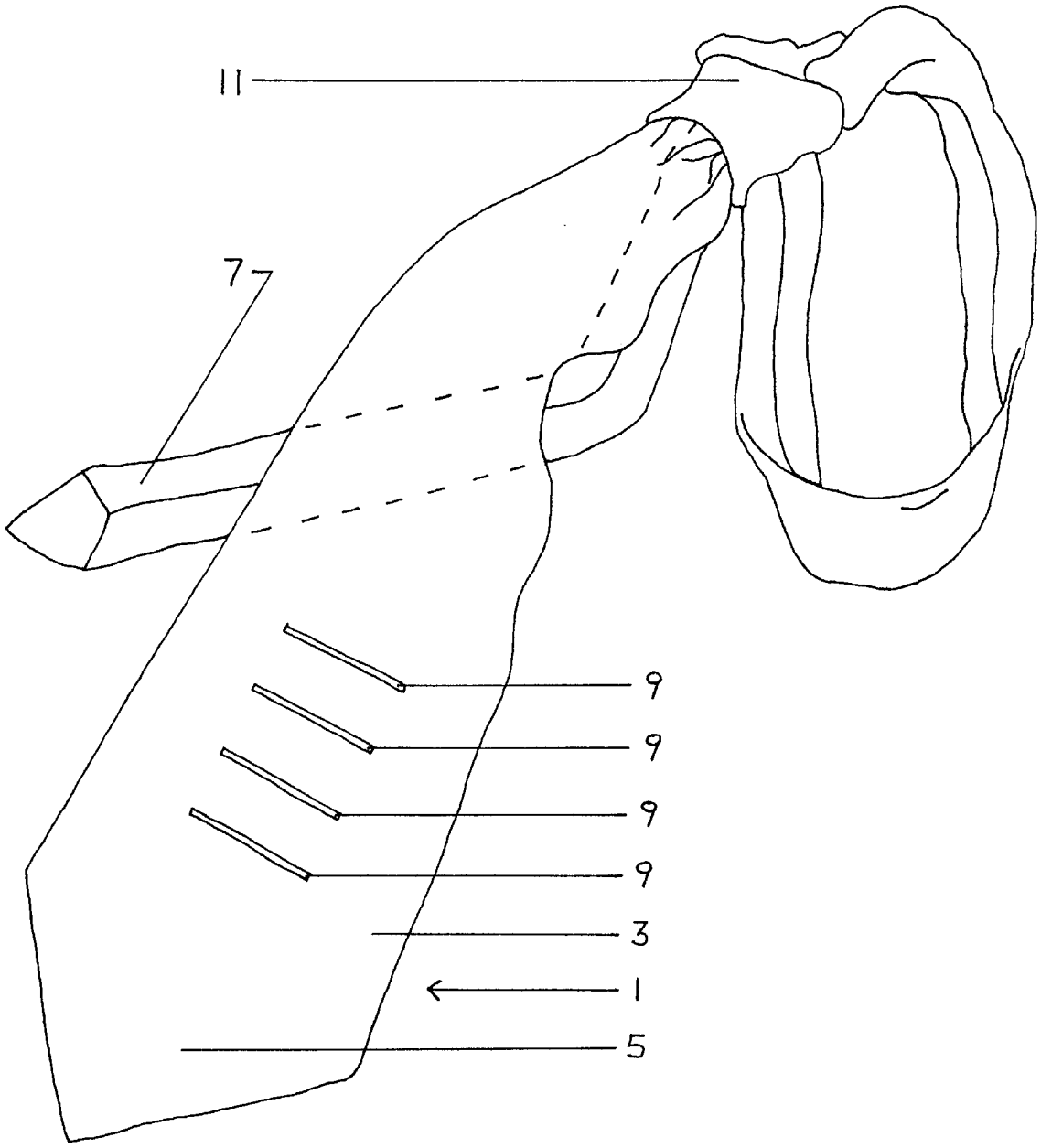
FIG. 1 provides a perspective view of the necktie made according to the present invention, wherein there are four openings, in the form of slits, in the necktie.

FIG. 1 provides a perspective view of the necktie made according to the present invention. Necktie 1 comprises shell 3 which is a fabric material formed over a lining, the lining not being visible in the figure. The necktie may be made of a plurality of pieces of fabric which have been sewn together. The necktie has wide end 5 (also known as an "apron") and narrow end 7. Disposed near the wide end are a plurality of openings 9 which, in FIG. 1, have the form of slits. The slits extend entirely through the fabric. Four slits are shown in the figure, but the number and shape of the slits can be changed, and there can be as few as one slit. The necktie is tied with a conventional knot 11.

As used in this specification, the term "narrow portion" refers to the relatively narrow part of the necktie which terminates in the narrow end. The term "wide portion" refers to the relatively wide part of the necktie which terminates in the wide end. Note that the boundary between the wide portion and the narrow portion is not clearly defined, but for practical purposes, the part of the necktie disposed below the knot, when the necktie is worn, can be considered the "wide portion", and the remainder of the necktie, i.e. the part that is located on the other side of the knot, can be considered the "narrow portion".

The essence of the invention is that the narrow portion of the necktie is inserted through at least one opening in the wide portion, so that part of the narrow portion is visible when the necktie is worn. The design created by the necktie may comprise a combination of the design elements located on the wide portion and the narrow portion. In general, the opening may take the form of a slit or a shaped cut-out.

Figure 2:
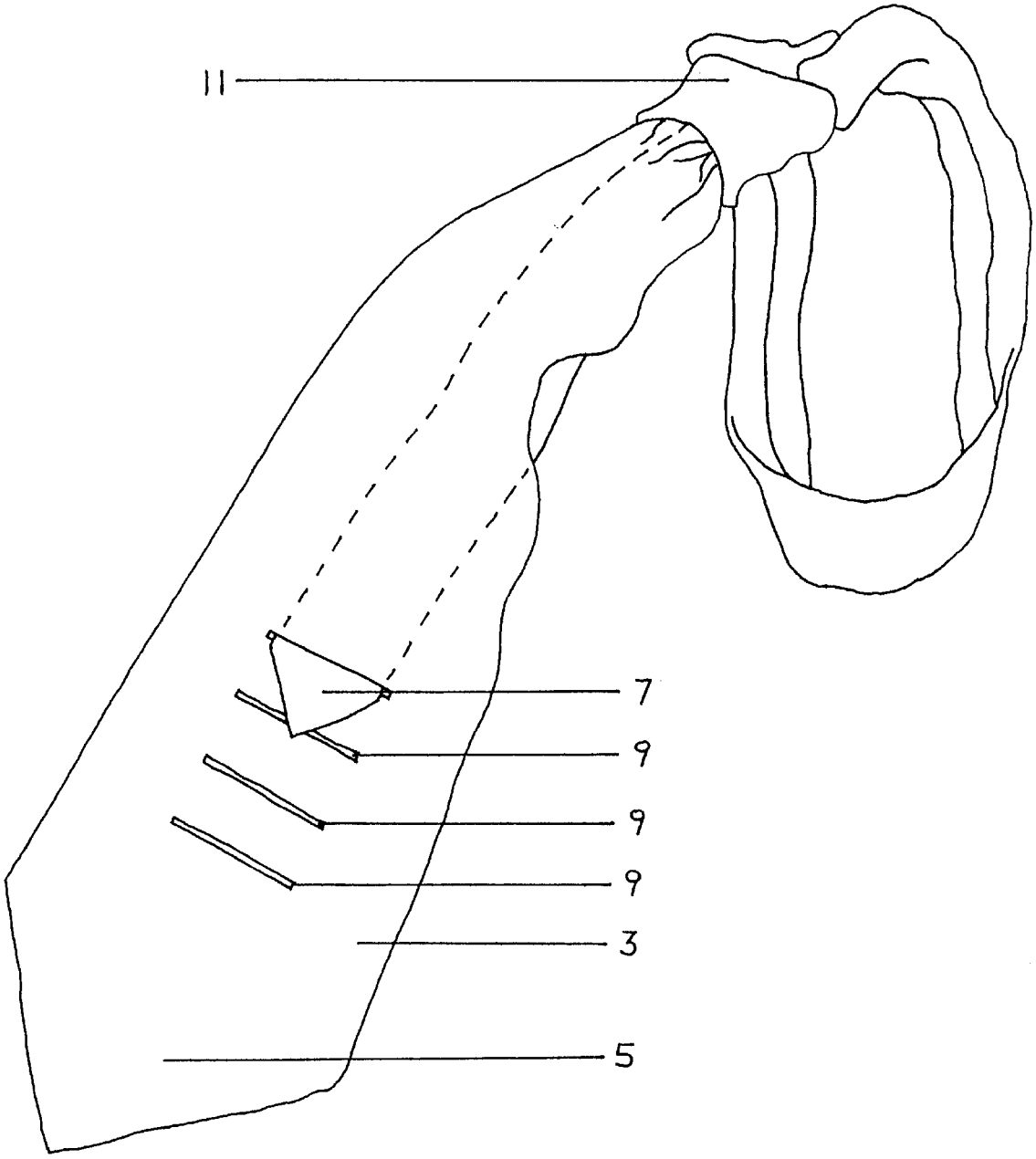
FIG. 2 provides a perspective view of the necktie, similar to FIG. 1, and showing the narrow end of the necktie being inserted through one of the slits.
Figure 3:
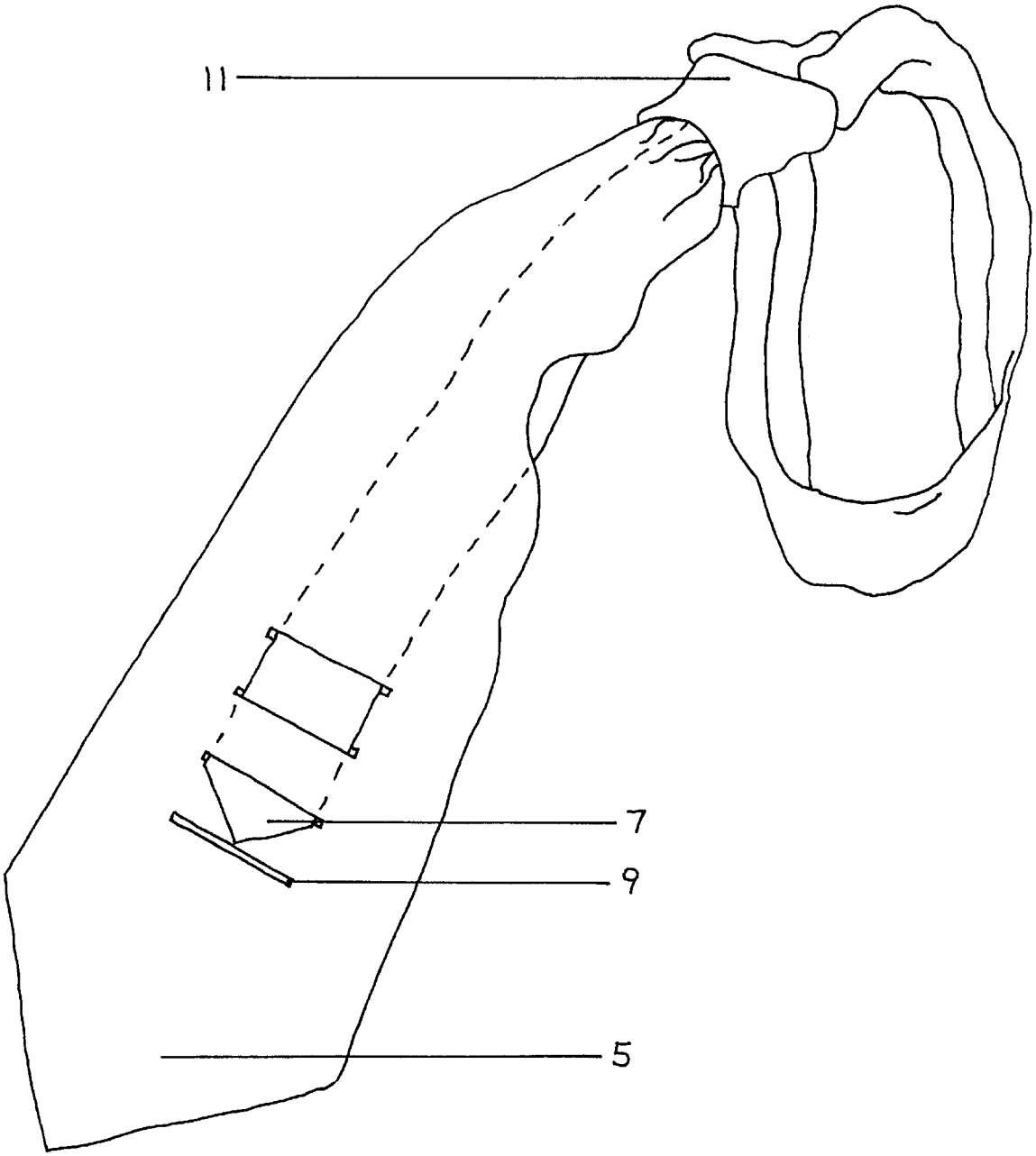
FIG. 3 provides a perspective view similar to that of FIGS. 1 and 2, and showing the narrow end of the necktie having been inserted through three of the slits to form a woven effect.
Figure 4:
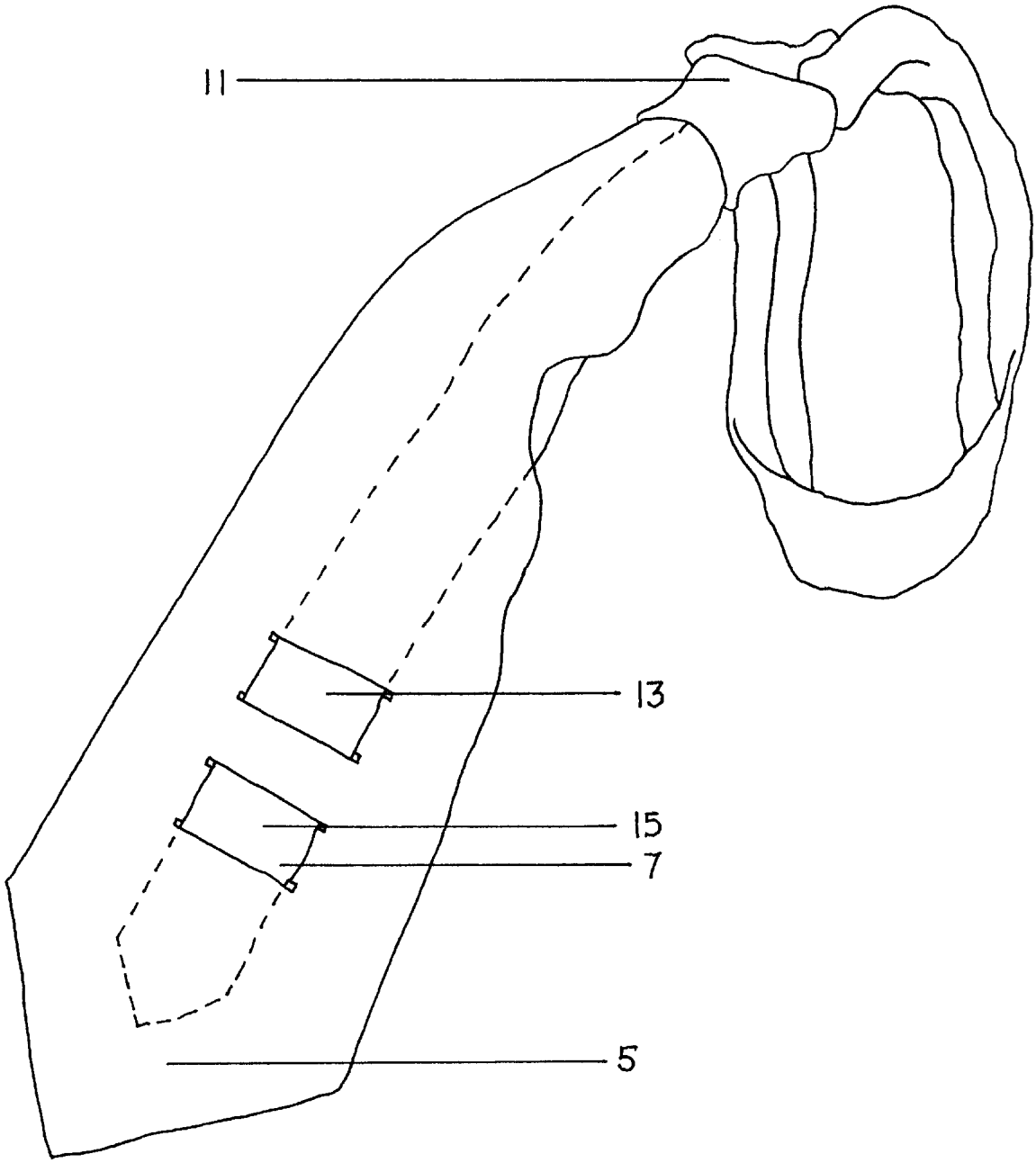
FIG. 4 provides a perspective view similar to those of FIGS. 1–3, and showing the narrow end having been inserted through all four of the slits.

FIGS. 2–4 show the steps performed in threading the narrow end of the necktie through a plurality of slits. In FIG. 2, the narrow end has been inserted through one of the slits 9. Note that the narrow end begins at the rear of the necktie, i.e. the side which is normally hidden from view when the necktie is worn, and emerges at the front of the necktie, so that the narrow end becomes visible.

In FIG. 3, the narrow end of the necktie, having emerged from the rear, has been again inserted through a slit, and re-inserted through another slit. Thus, the narrow portion becomes visible along an area determined by the distance between successive slits, and then disappears from view, re-emerging at the next slit. In FIG. 4, the narrow end of the necktie has been inserted into the last slit, so that the tip of the narrow end itself is not normally visible, as indicated by the dotted lines. However, two parts of the narrow portion of the necktie are now visible, these parts being designated by reference numerals 13 and 15. It will be apparent that the precise parts of the narrow portion that are visible will depend on how far the narrow end is pulled down by the wearer. The latter fact has significance in varying the design of the necktie, as will be apparent from the discussion below.

It should be appreciated that there is no requirement, in the present invention, that the narrow portion be threaded into and out of the slits, in the manner shown in FIGS. 2–4. Instead, there may be only a single slit, and the narrow portion of the necktie would then pass through the slit only once. The examples discussed below will show how even one slit can be used to create novel designs for the necktie.

Figure 5:
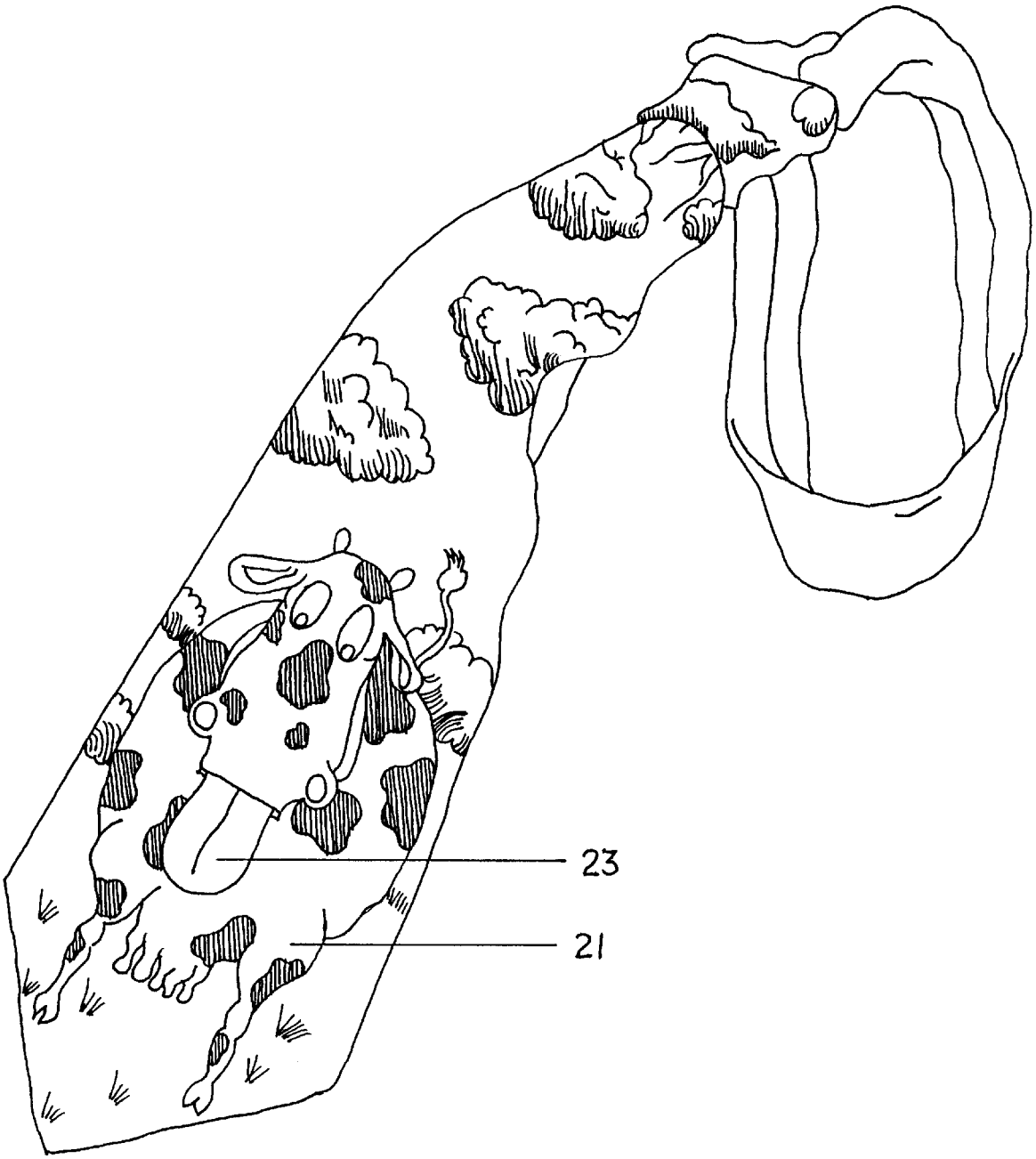
FIG. 5 provides a perspective view of the necktie of the present invention, wherein the wide end contains a design of a cow, and wherein the narrow end represents a tongue extending from the mouth of the cow.

FIG. 5 provides an example wherein the wide portion of the necktie has been decorated with the design of a cow 21. The narrow portion 23 of the necktie has been decorated to have the appearance of a tongue, and the narrow portion has been inserted through a single slit such that the tongue appears to belong to the cow. In the embodiment of FIG. 5, the narrow end has been rounded to enhance its resemblance to a tongue. Adjusting the position of the narrow end has the effect of increasing the apparent length of the cow's tongue. Thus, the appearance of the cow design can be changed by varying the length of the narrow portion that extends through the slit. Note that the manner in which a conventional necktie is tied determines the length of the narrow portion of the necktie, as is well-known to those who wear neckties. By making the portion below the knot shorter, the effective length of the narrow portion becomes longer, and vice versa. Thus, varying the apparent length of the tongue is within the level of skill of anyone who ties a conventional necktie.

Figure 6:
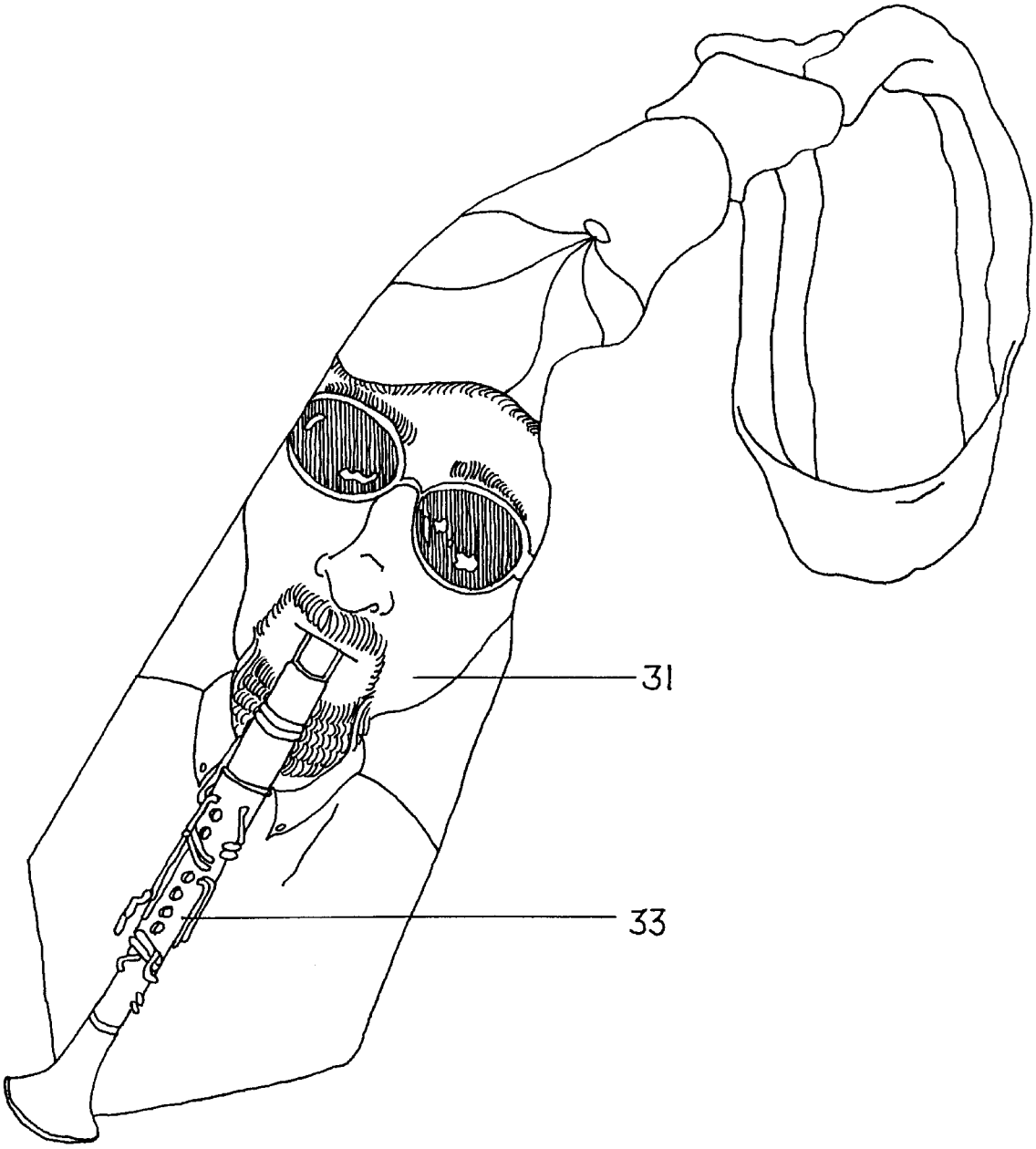
FIG. 6 provides a perspective view of the necktie of the present invention, wherein the wide end contains a depiction of a musician, and wherein the narrow end represents a clarinet being played by the musician.

FIG. 6 shows another example of a necktie made according to the present invention. This necktie also has only one slit in the wide portion. The wide portion contains a depiction of a musician 31, and the narrow portion 33 has the appearance of a clarinet. When the narrow portion extends from the slit by a sufficient distance, the narrow portion creates the appearance of a clarinet that is being played by the musician.

Figure 7:
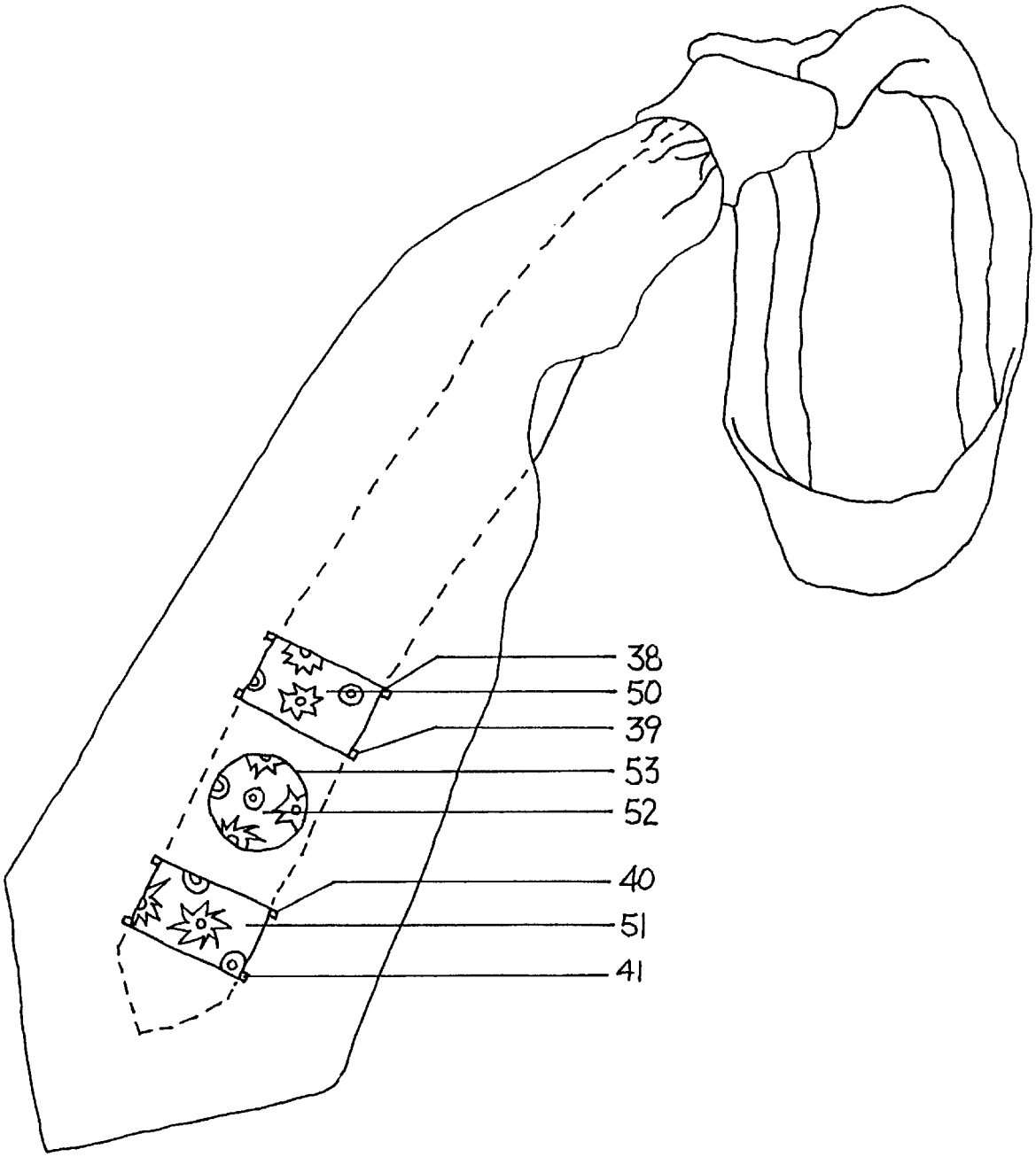
FIG. 7 provides a perspective view of another embodiment of the present invention, showing a kind of design that can be created by weaving the narrow end of the necktie into and out of the slits formed in the wide end.

FIG. 7 provides an example of a necktie made according to the present invention, somewhat similar to that shown in FIG. 4. In this example, there are four slits 38, 39, 40, and 41. The narrow portion of the necktie is threaded through the slits in the same manner shown in FIG. 4. The narrow portion contains design elements which become visible at the positions indicated by reference numerals 50 and 51. The design elements are formed entirely on the narrow portion, and the wide portion is punched out to expose the design elements of the narrow portion. In FIG. 7, the wide portion has a disk-shaped cut-out 53 which exposes the design element 52 of the narrow portion. But other shapes could be used instead, and there could be multiple cut-outs. In the most general case, there can be a plurality of cut-out parts of the wide portion, and these cut-out parts can assume different shapes, such as squares, circles, semicircles, rectangles, triangles, parallelograms, and other shapes.

In the example of FIG. 7, the cut-out is used simply to expose the design formed on the narrow portion of the necktie. It is also possible for the narrow portion to be inserted through the cut-out, within the scope of the invention.

Alternatively, the wide portion of the necktie could contain a design element, similar to design element 52, which matches or complements the design elements formed on the narrow portion. That is, instead of providing a hole or cut-out which exposes part of the narrow portion, the wide portion is simply provided with its own design elements which are intended to complement those of the narrow portion that become exposed. This alternative should be considered within the scope of the invention.

The narrow portion of the necktie could also be provided with a design or pattern which matches a design or pattern of other clothing being worn. For example, the narrow portion could have a pattern that matches that of the sport jacket and/or pants worn by the user.

The cut-out formed in the wide portion could be placed anywhere. The cut-out could be coordinated with a design or pattern formed on the wide portion. For example, if the wide portion has a pattern comprising a plurality of circles (such as a set of polka dots), one of the circles could be positioned to coincide with a cut-out. There could also be a plurality of such cut-outs, coordinated with the circles.

The design formed by the necktie of the present invention is a composite formed of the design on the wide portion and the design on the narrow portion. The designs on the wide portion and narrow portion can be complex designs which are intended to complement each other when the narrow portion is passed through the cut-out, or they can be very simple, such as colored areas. For example, the wide portion could be made of one color, and the narrow portion could be made of another color, and the composite design could result from the juxtaposition of the contrasting colors.

Many other embodiments of the invention can be constructed. For example, the cow of FIG. 5 could be replaced by virtually any other animal, with the narrow portion of the necktie representing the tongue of the animal. In particular, the narrow portion could represent the trunk of an elephant, the head of the elephant being depicted on the wide portion. The narrow portion could depict the tongue of a dog, the head of the dog being shown on the wide portion.

Instead of representing a clarinet as in FIG. 6, the narrow portion of the necktie could represent some other instrument, such as a trumpet or oboe. In the case of a musical instrument, it may be necessary to tie the necktie with considerable precision and skill, so that an exact, predetermined length of the narrow portion is visible. Also, for embodiments such as that of FIG. 6, the overall length of the necktie may need to be greater than for a conventional necktie, in view of the fact that the narrow portion must extend from the slit by a relatively long distance.

Still other variations are possible. In one such variation, the wide portion of the necktie depicts a famous person who wears a necktie. The narrow portion would represent the necktie itself, and adjusting the length of the narrow portion would effectively alter the apparent length of the necktie worn by the famous individual. The slit in the wide portion would be formed at the base of the image of the knot of the famous person's tie, so that the narrow portion would represent the tie itself.

In another variation, the wide portion of the necktie depicts a chrome tape measure, with the narrow portion representing the scaled tape of the tape measure.

In another variation, the wide portion could depict a medieval knight, with the narrow portion representing the knight's sword.

In another variation, the wide portion could depict a hot dog bun with various condiments, with the narrow portion representing the hot dog itself.

In another variation, the wide portion could depict a face of a man or woman, with the narrow portion representing a cigar extending from the face.

In still another variation, the wide portion could depict the folk character known as "the old woman who lived in a shoe", with the narrow portion showing children tumbling out of the woman's house.

In another variation, the wide portion of the necktie contains a design showing a fisherman extending a fishing reel and fishing line, and the narrow portion could represent a fish which is caught on the line. Adjustment of the position of the narrow portion varies the position of the fish relative to the fishing reel.

In still another variation, the wide portion of the necktie can contain an illustration suitable for a holiday, such as a candy cane, with the narrow portion comprising an extension of the candy cane. Thus, the apparent length of the candy cane can be increased by increasing the length of the narrow portion.

In still another variation, the wide portion of the necktie depicts an open mouth of a patient in a dentist's chair, as would be viewed by the dentist, and the narrow portion would represent the patient's tongue extending downward.

In another variation, the wide portion can contain a depiction of a frog swimming "down" the necktie, with the narrow portion representing a tongue of the frog on which there is a depiction of a fly.

In still another variation, the wide portion can contain a representation of Pinocchio, with the narrow portion representing the nose of the character, with an ever-changing length.

In the most general case, the slits or cut-outs need not be horizontal, but could instead be oblique to the longitudinal axis of the wide portion of the necktie. Stated another way, the openings could be perpendicular or non-perpendicular to the edge of the wide portion. There could even be a plurality of obliquely-oriented openings.

The reader skilled in the art will recognize that there are virtually endless further variations on the basic concept of the invention as disclosed above. Such variations should be considered within the spirit and scope of the following claims.

What is claimed is:

1. In a necktie, the necktie having a wide portion and a narrow portion, the necktie being made of a fabric material, the improvement comprising at least one opening formed in the wide portion, the opening passing completely through said fabric material, wherein the wide portion contains a first design relating to a first theme, and wherein the narrow portion contains a second design relating to a second theme, wherein said first and second themes are related to each other, such that when the narrow portion is inserted through the opening, the necktie displays a third design which comprises a combination of said first and second designs, said third design relating to at least one of said first and second themes.

2. The improvement of claim 1, wherein the opening comprises a slit.

3. The improvement of claim 2, wherein there are a plurality of slits in the wide portion of the necktie.

4. The improvement of claim 3, wherein the slits are generally parallel to each other.

5. The improvement of claim 4, wherein the wide portion has an edge, and wherein the slits are generally perpendicular to said edge.

6. The improvement of claim 4, wherein the wide portion has an edge, and wherein the slits are generally oblique to said edge.

7. The improvement of claim 1, wherein the opening comprises a shaped cut-out.

8. A necktie comprising a wide portion and a narrow portion, the wide portion having a front side and a back side, the necktie being made of a fabric material, the necktie having at least one opening in the wide portion, the opening passing completely through the fabric material, wherein the narrow portion of the necktie is inserted through the opening such that at least a part of the narrow portion is disposed on the front side of the wide portion of the necktie, wherein the front side of the wide portion contains a first design relating to a first theme, and wherein the narrow portion contains a second design relating to a second theme, wherein said first and second themes are related to each other, and wherein the necktie defines a third design which comprises a combination of said first design and said second design, said third design relating to at least one of said first and second themes.

9. The necktie of claim 8, wherein the opening comprises a slit.

10. The necktie of claim 8, wherein the opening comprises a cut-out.

11. The necktie of claim 10, wherein the cut-out exposes some of the narrow portion.

12. A necktie having a wide portion and a narrow portion, the wide portion having at least one opening formed therein, the narrow portion being inserted through the opening, wherein the wide portion contains a first design relating to a first theme, and wherein the narrow portion contains a second design relating to a second theme, wherein said first and second themes are related to each other, and wherein parts of both the wide portion and the narrow portion are visible, and wherein the wide portion and narrow portion together define a third design which comprises a combination of the first and second designs and which relates to at least one of said first and second themes.

13. A method of configuring a necktie, the necktie having a wide portion and a narrow portion, the method comprising the step of threading the narrow portion through an opening formed in the wide portion such that at least part of the narrow portion is visible when the necktie is worn, wherein the wide portion contains a first design, and wherein the narrow portion contains a second design, and wherein the necktie defines a third design formed of a combination of the first and second designs, and wherein the method further comprises the step of altering the appearance, and adjusting a length of the narrow portion thereby altering an appearance of the third design.

14. The method of claim 13, wherein there are a plurality of openings in the wide portion, and wherein the narrow portion is threaded through a plurality of openings.

15. The method of claim 14, wherein the narrow portion is threaded alternately from a back side of the wide portion to a front side of the wide portion, wherein the narrow portion becomes woven around the openings.

16. The method of claim 13, wherein the necktie is tied such that the narrow portion has a predetermined length, wherein a design formed on the narrow portion complements a design formed on the wide portion.

* * * * *